US009206622B2

(12) United States Patent
Lila

(10) Patent No.: US 9,206,622 B2
(45) Date of Patent: Dec. 8, 2015

(54) ENERGY ABSORBING LOCK SYSTEMS AND METHODS

(71) Applicant: Flexible Security LLC, Hudson, WI (US)

(72) Inventor: Bradley A. Lila, Hudson, WI (US)

(73) Assignee: Flexible Security LLC, Hudson, WI (US)

( * ) Notice: Subject to any disclaimer, the term of this patent is extended or adjusted under 35 U.S.C. 154(b) by 0 days.

(21) Appl. No.: 14/211,153

(22) Filed: Mar. 14, 2014

(65) Prior Publication Data

US 2014/0260446 A1 Sep. 18, 2014

Related U.S. Application Data

(60) Provisional application No. 61/782,542, filed on Mar. 14, 2013.

(51) Int. Cl.
*E05B 65/06* (2006.01)
*E05B 15/10* (2006.01)
(Continued)

(52) U.S. Cl.
CPC ..... *E05B 15/10* (2013.01); *E05B 17/0058* (2013.01); *E05B 17/2084* (2013.01); *Y10T 70/5341* (2015.04); *Y10T 292/1014* (2015.04)

(58) Field of Classification Search
CPC ..... E05B 65/0082; E05B 17/2092; E05B 51/023; E05B 17/2084; E05B 17/2088
USPC ..... 70/1.5, 416, 118–120, 129, 130, 133, 70/134, 136, 150, 151 R, 151 A, 153; 292/340, 341.12, 341.11, 341.13, 346; 109/59 R
See application file for complete search history.

(56) References Cited

U.S. PATENT DOCUMENTS 913,410 A * 2/1909 Marbach ..... 292/341.18
1,443,635 A * 1/1923 Moore ..... 292/173
(Continued)

FOREIGN PATENT DOCUMENTS

CN 1144298 A 3/1997
CN 201963049 U 9/2011
(Continued)

OTHER PUBLICATIONS

Munchkin Xtraguard 2 Count Dual Action Multi Use Latches, Amazon.com, 7 pages (Apr. 11, 2014).
(Continued)

*Primary Examiner* — Suzanne Barrett
(74) *Attorney, Agent, or Firm* — Merchant & Gould P.C.

(57) ABSTRACT

A door lock secures a door when closed within a doorframe. The lock includes a bolt guide, a bolt, a bolt actuator, and a bolt receiver. The bolt includes a first portion that is adjacent to a proximal end and a second portion that is adjacent a distal end of the bolt. The actuator moves the bolt along the bolt guide between a locked position and an unlocked position. The second portion extends beyond the guide when in the locked position and is received by the receiver. The bolt deforms within the receiver and thereby predominantly absorbs energy from an intrusion load. A maximum deformation of the bolt prior to failure of the lock from the intrusion load is at least 4%, 25%, or 120% of a thickness of the bolt. A maximum deformation of the bolt prior to failure of the lock may be at least 40%, 55%, or 72% of a maximum overall deflection of the lock. The receiver may include a deformation guide that guides deformation of the bolt.

18 Claims, 7 Drawing Sheets

(51) Int. Cl.
*E05B 17/20* (2006.01)
*E05B 17/00* (2006.01)

(56) References Cited

U.S. PATENT DOCUMENTS

| | | | | | |
|---|---|---|---|---|---|
| 1,486,595 | A | * | 3/1924 | Marcum | 292/169.21 |
| 1,604,540 | A | * | 10/1926 | Taggart, Jr. | 292/173 |
| 2,024,329 | A | * | 12/1935 | Reesley | 70/464 |
| 2,116,305 | A | * | 5/1938 | Devereaux | 49/400 |
| 2,159,362 | A | * | 5/1939 | Aumack | 292/341.12 |
| 2,770,482 | A | | 11/1956 | Kusiek | |
| 3,152,825 | A | * | 10/1964 | Schlage | 292/340 |
| 3,825,289 | A | * | 7/1974 | Armstrong | 292/163 |
| 3,966,248 | A | * | 6/1976 | James | 292/340 |
| 4,076,294 | A | * | 2/1978 | Holmberg | 292/340 |
| 4,109,948 | A | | 8/1978 | Potter et al. | |
| 4,169,618 | A | | 10/1979 | Potter et al. | |
| 4,245,567 | A | * | 1/1981 | Herrmann | 109/64 |
| 4,333,324 | A | | 6/1982 | Dietrich et al. | |
| 4,474,393 | A | | 10/1984 | Kimura | |
| 4,605,251 | A | | 8/1986 | Finlay | |
| 4,629,229 | A | | 12/1986 | Correnti et al. | |
| 4,712,393 | A | * | 12/1987 | Deschamps et al. | 70/1.5 |
| D303,351 | S | * | 9/1989 | Weinerman et al. | D8/344 |
| 4,865,248 | A | * | 9/1989 | Barth | 232/24 |
| 5,121,950 | A | * | 6/1992 | Davidian | 292/164 |
| 5,249,831 | A | * | 10/1993 | Maniaci | 292/144 |
| 5,904,041 | A | * | 5/1999 | Dhainault | 60/226.2 |
| 6,224,309 | B1 | * | 5/2001 | Yamamoto | 411/11 |
| 6,481,252 | B2 | | 11/2002 | Calle et al. | |
| 6,641,185 | B2 | | 11/2003 | Hale et al. | |
| 7,350,838 | B2 | | 4/2008 | Schlattl et al. | |
| 8,337,120 | B2 | * | 12/2012 | Li | 405/259.5 |
| 2004/0035159 | A1 | * | 2/2004 | Hirvi | 70/100 |
| 2006/0214437 | A1 | * | 9/2006 | Farzan | 292/340 |
| 2008/0042451 | A1 | | 2/2008 | Moore et al. | |
| 2014/0265367 | A1 | * | 9/2014 | Lila | 292/253 |

FOREIGN PATENT DOCUMENTS

| | | |
|---|---|---|
| EP | 0 104 126 B1 | 4/1986 |
| JP | 5-202663 | 8/1993 |
| JP | 6-307145 | 11/1994 |
| JP | 2007-63902 | 3/2007 |

OTHER PUBLICATIONS

Solid Brass 4 Inch Security Door Guard, Deltana DG425—Doorware.com, http://www.dooreware.com/site/product.cfm?id=7684, 2 pages (Copyright 2013).

The Ultimate Lock™ 3000 Series Installation Guide,8 pages (Feb. 3, 2013).

U.S. Appl. No. 14/211,738, filed Mar. 14, 2014 entitled "Energy Absorbing Latch Systems and Methods".

* cited by examiner

FIG. 1
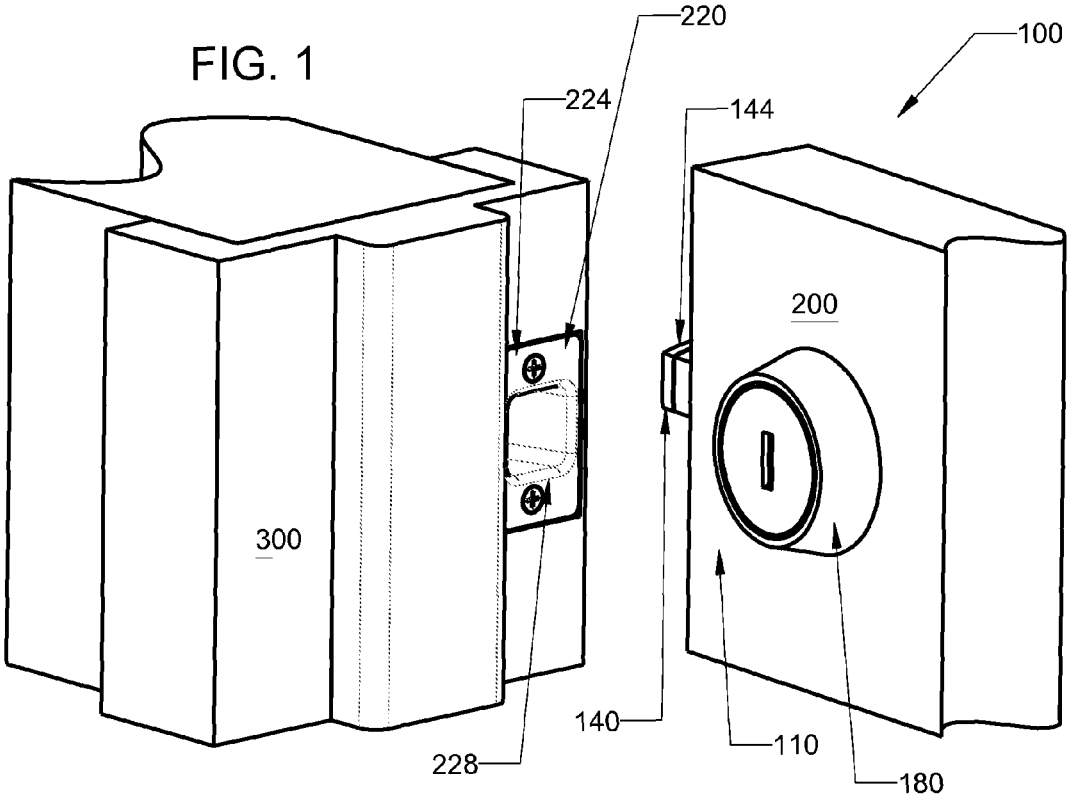
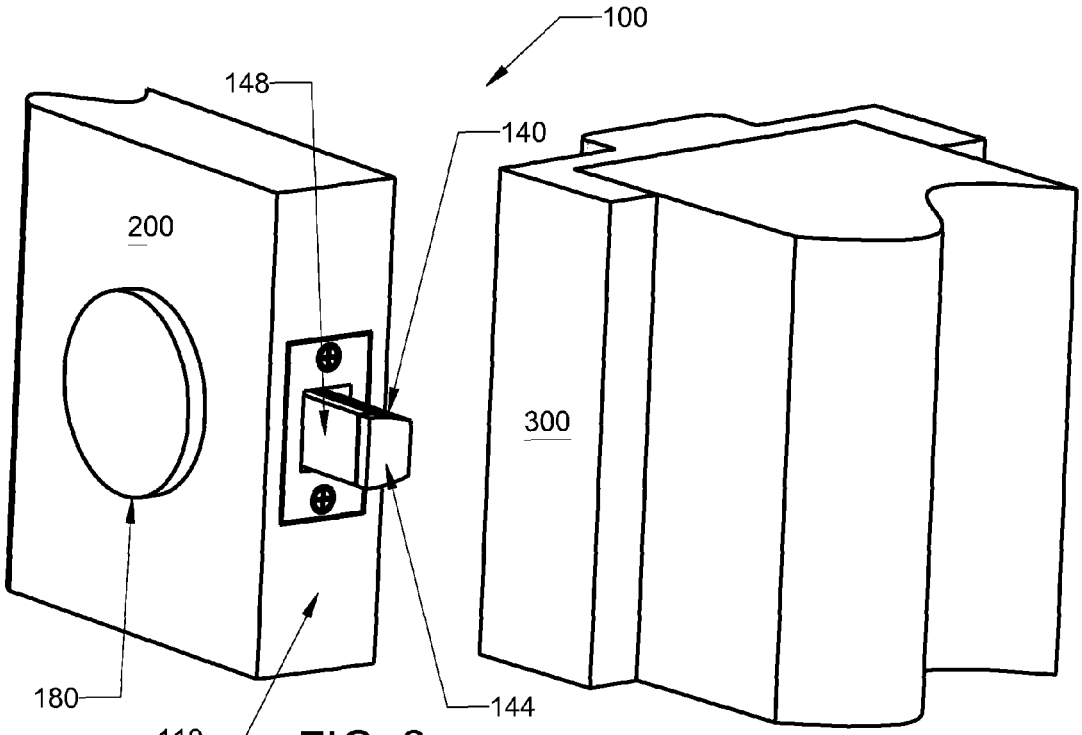
FIG. 2

ENERGY ABSORBING LOCK SYSTEMS AND METHODS

CROSS REFERENCE TO RELATED APPLICATION

The present application claims the benefit of U.S. Provisional Patent Application Ser. No. 61/782,542, filed Mar. 14, 2013, entitled ENERGY ABSORBING LOCK SYSTEMS AND METHODS, the disclosure of which is hereby incorporated by reference in its entirety.

BACKGROUND

Exterior doors of homes, office buildings, hotels, apartment buildings, etc. are typically equipped with some means (e.g., a door lock) of securing entry into the building. Interior doors of such buildings may also be equipped with some means of securing the door. Such door lock apparatuses are typically rigid and mechanical and to some extent easily defeated by a sudden and forceful action, such as kicking or shouldering. An average adult male is capable of generating a significant amount of force over an effective area of the door lock while using a violent swift action directed at the door lock. In instances of forced entry through the door, the more direct a strike is directed to the door lock, the more successful a perpetrator is at defeating the door lock, typically.

SUMMARY

According to certain aspects of the present disclosure, a door lock assembly is adapted to secure a door in a closed configuration within a doorframe. The door lock assembly includes a bolt guide, a bolt, a bolt actuator, and a bolt receiver. The bolt extends between a proximal end and a distal end. The bolt includes a first portion that is adjacent to the proximal end and a second portion that is adjacent to the distal end. The bolt actuator is adapted to move the bolt along the bolt guide between a locked position and an unlocked position. The second portion of the bolt extends beyond the bolt guide when the bolt is moved to the locked position. The bolt receiver is adapted to receive the second portion of the bolt when the bolt is moved to the locked position. The bolt is adapted to deform within the bolt receiver and thereby absorb energy delivered to the door lock assembly by an intrusion load. The energy delivered to the door lock assembly by the intrusion load is predominantly absorbed by deformation of the bolt.

In certain embodiments, the bolt is a deadbolt. The bolt actuator may be actuated by a key via a keyhole of the door lock assembly. The bolt receiver may include an integral strike plate. The bolt receiver may be a cup shaped bolt receiver and may be adjacent the second portion of the bolt along at least three sides of the second portion of the bolt when the bolt is moved to the locked position. The cup shaped bolt receiver may be adjacent the second portion of the bolt along all exterior sides of the second portion of the bolt when the bolt is moved to the locked position. The bolt receiver may include a first portion that is adapted to receive the second portion of the bolt when the bolt is moved to the locked position and no intrusion load is placed on the door. The bolt receiver may include a second portion adapted to receive at least some of the second portion of the bolt when the bolt is positioned at the locked position and the intrusion load is placed on the door thereby deforming the bolt.

In certain embodiments, the second portion of the bolt receiver may include a deformation guide that guides the deformation of the bolt when the intrusion load is placed on the door. The deformation guide of the second portion of the bolt receiver may include a taper. The deformation of the bolt may be elastic deformation and/or may be inelastic deformation (i.e., may result in yielding of the bolt). The bolt guide may be mounted to the door and the bolt receiver may be mounted to the doorframe. In other embodiments, the bolt guide may be mounted to the doorframe and the bolt receiver may be mounted to the door.

In certain embodiments, the bolt may include a spring metal core that is surrounded by an energy absorbing polymer. The bolt may further include a metal end cap at the distal end that is connected to the spring metal core. The bolt guide may include a deformation guide that guides the deformation of the bolt when the intrusion load is placed on the door.

According to other aspects of the present disclosure, a door lock assembly is adapted to secure a door in a closed configuration within a doorframe. The door lock assembly includes a bolt guide, a bolt, a bolt actuator, and a bolt receiver. The bolt extends between a proximal end and a distal end. The bolt includes a first portion that is adjacent to the proximal end, a second portion that is adjacent to the distal end, and a thickness. The bolt actuator is adapted to move the bolt along the bolt guide between a locked position and an unlocked position. The second portion of the bolt extends beyond the bolt guide when the bolt is moved to the locked position. The bolt receiver is adapted to receive the second portion of the bolt when the bolt is moved to the locked position. The bolt is adapted to deform within the bolt receiver and thereby absorb energy delivered to the door lock assembly by an intrusion load. A maximum deformation of the bolt prior to failure of the door lock assembly from the intrusion load is at least 4% of the thickness of the bolt. In certain embodiments, the maximum deformation of the bolt prior to the failure of the door lock assembly is at least 25% of the thickness of the bolt. In certain embodiments, the maximum deformation of the bolt prior to the failure of the door lock assembly is at least 120% of the thickness of the bolt.

Still other aspects of the present disclosure are directed to a door lock assembly that is adapted to secure a door in a closed configuration within a doorframe. The door lock assembly includes a bolt guide, a bolt, a bolt actuator, and a bolt receiver. The bolt extends between a proximal end and a distal end. The bolt includes a first portion that is adjacent to the proximal end, a second portion that is adjacent to the distal end. The bolt actuator is adapted to move the bolt along the bolt guide between a locked position and an unlocked position. The second portion of the bolt extends beyond the bolt guide when the bolt is moved to the locked position. The bolt receiver is adapted to receive the second portion of the bolt when the bolt is moved to the locked position. The bolt is adapted to deform within the bolt receiver and thereby absorb energy delivered to the door lock assembly by an intrusion load. A maximum deformation of the bolt prior to failure of the door lock assembly from the intrusion load is at least 40% of a maximum overall deflection of the door lock assembly. In certain embodiments, the maximum deflection of the bolt prior to the failure of the door lock assembly is at least 55% of the maximum overall deflection of the door lock assembly. In certain embodiments, the maximum deflection of the bolt prior to the failure of the door lock assembly is at least 72% of the maximum overall deflection of the door lock assembly.

Yet other aspects of the present disclosure are directed to a door lock assembly that is adapted to secure a door in a closed configuration within a doorframe. The door lock assembly includes a bolt guide, a deformable bolt, a bolt actuator, and a bolt receiver. The deformable bolt extends between a proximal end and a distal end. The deformable bolt includes a first portion that is adjacent to the proximal end, a second portion that is adjacent to the distal end. The bolt actuator is adapted to move the deformable bolt along the bolt guide between a locked position and an unlocked position. The second portion of the deformable bolt extends beyond the bolt guide when the deformable bolt is moved to the locked position. The bolt receiver is adapted to receive the second portion of the deformable bolt when the deformable bolt is moved to the locked position. The bolt receiver includes a deformation guide that is adapted to guide deformation of the deformable bolt.

A variety of additional aspects will be set forth in the description that follows. These aspects can relate to individual features and to combinations of features. It is to be understood that both the foregoing general description and the following detailed description are exemplary and explanatory only and are not restrictive of the broad concepts upon which the embodiments disclosed herein are based.

BRIEF DESCRIPTION OF THE DRAWINGS

FIG. 1 is a partial exploded perspective view of a door lock system according to the principles of the present disclosure;

FIG. 2 is a partial reverse perspective view of the door lock system of FIG. 1;

DETAILED DESCRIPTION

Figure 4:
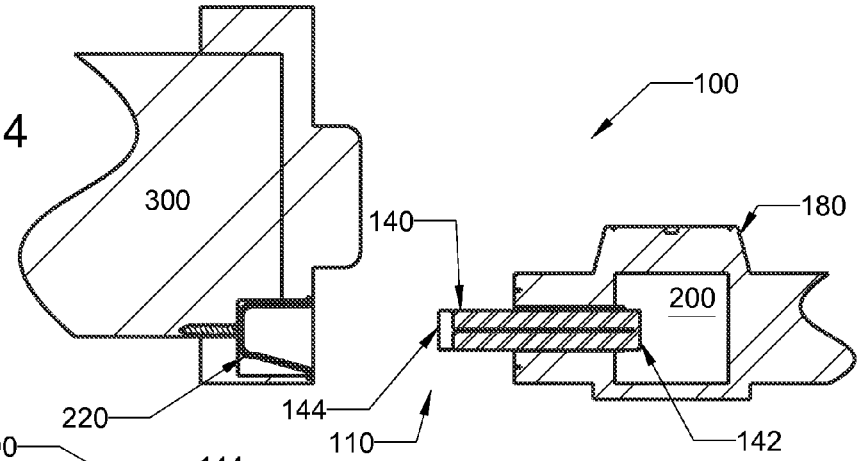
FIG. 4 is a partial exploded cross-sectional plan view of the door lock system of FIG. 1, as called out at FIG. 3.

According to the principles of the present disclosure an energy absorbing lock system 100, and in particular, a system including an energy absorbing bolt 140 (e.g., an energy absorbing deadbolt) is effective at preventing entry through a door 200 by dynamic action that is applied to the door 200. Such dynamic action may include kicking with a foot, shouldering with a shoulder, and ramming with a police-style battering ram. In contrast, typical conventional bolt-style lock systems and typical conventional latch systems are susceptible to failure from application of such dynamic action, thereby allowing entry through the door.

In various embodiments, the energy absorbing bolt 140 may be made of various energy absorbing materials and/or deformable materials. The energy absorbing materials and/or the deformable materials may include energy absorbing plastics (e.g., polycarbonate, PVC, etc.), energy absorbing rubbers (neoprene, isoprene, etc.), energy absorbing composites, etc. In one embodiment, the energy absorbing bolt 140 includes 60 durometer PVC. In another embodiment, the energy absorbing bolt 140 includes 50 durometer PVC.

The typical bolt-style lock systems and the typical latch systems are substantially inflexible and have minimal energy absorption qualities. Energy that is applied to the door by the dynamic action is concentrated upon a connection between a deadbolt and strikeplate in the case of the typical bolt-style lock system and is concentrated upon a connection between a latch and a catch in the case of the typical latch system. The typical latch system and the typical bolt-style lock system may be included on the same door and offer a modest amount of improvement in preventing entry as the dynamic action causes failure of both the typical latch system and the typical bolt-style lock system. The failure of the typical latch system and/or the typical bolt-style lock system may or may not occur from failure of the deadbolt and/or the strikeplate, in the case of the typical bolt-style lock system, and/or failure of the latch and/or the catch, in the case of the typical latch system. The failure of the typical latch system and/or the typical bolt-style lock system may or may not occur from failure of connecting structure (e.g. the door, a connection between the door and the bolt-style lock system, a doorframe, a connection between the doorframe and the bolt-style lock system, a connection between the door and the latch system, a connection between the doorframe and the latch system, etc.). As, the typical latch system and the typical bolt-style lock system are substantially inflexible, the energy delivered by the dynamic action may result in impact of relatively short time duration and relatively high force levels. The high force levels may cause high stresses to develop in the above-mentioned parts and the high stresses may cause the failure.

In contrast, according to the principles of the present disclosure, the energy absorbing lock system 100 includes the deformable bolt 140 that is substantially flexible. The energy delivered by the dynamic action may result in impact of relatively long time duration and relatively low force levels. The relatively low force levels may result in lower stresses developing in corresponding parts and the lower stresses may be below a failure point. In addition, the deformable bolt 140 absorbs the energy delivered by the dynamic action and may dissipate the energy as heat.

The energy absorbing lock system 100 is therefore a device designed to absorb and thwart the concentrated energy of an attempted forced entry through the door 200 or a similar access point. When a perpetrator places a sudden force onto the door, the substantially rigid mechanisms of the typical bolt-style lock system and/or the typical latch system designs often fail due to their inability to absorb the energy. The energy absorbing lock system 100 will, in most cases, absorb the energy and return the door 200 to its original position. In cases where there are only substantially rigid mechanisms, repeated blows often weaken (e.g., fatigue, cause crack initiation and crack growth, etc.) the lock/latch assemblies and the door/doorframe until a point of failure is reached. The energy absorbing lock system's 100 absorption qualities continue to function after repeated blows.

Extensible material is used in the deformable bolt 140. In certain embodiments, the extensible material is neoprene and/or isoprene. As depicted, the extensible material may be formed into the deformable bolt 140. A proximal end 142 of the extensible material may be operably connected (e.g., molded) to an actuator 180 (e.g., a conventional metal actuator) of the energy absorbing lock system 100. A key and/or other rotating input may actuate the deformable bolt 140 between a locked configuration and an unlocked configuration.

A bolt receiver 220 (i.e., a female portion) is separate from a deformable bolt and actuator assembly 110. The bolt receiver 220 may be a single piece (e.g., a steel piece, a formed piece, a forged piece, and/or a solid piece, etc.) that includes a deformation guiding portion 230 (see FIGS. 9 and 10). The bolt receiver 220 may be secured directly to a doorframe 300. The bolt receiver 220 may be secured directly to the doorframe 300 at a jamb 310 of the doorframe 300. The energy from the sudden blow is expended, absorbed, and/or dissipated as the deformable bolt 140 is bent, stretched, and/or compressed. The bending, stretching, and/or compressing of the deformable bolt 140 may be guided, at least in part, by the deformation guiding portion 230. The bending, stretching, and/or compressing of the deformable bolt 140 may cause a recoiling effect and urge and/or force the door 200 back to its original position.

A metal insert 160 may be provided in the deformable bolt 140. The metal insert 160 may be made of spring steel. The metal insert 160 may connect to the actuator 180. A cap 170 may be provided at a distal end 144 of the deformable bolt 140. The cap 170 may connect to the metal insert 160. The metal insert 160 may provide tensile reinforcement to the deformable bolt 140. The metal insert 160 may provide a tensile connection between the actuator 180 and the cap 170.

The energy absorbing lock system 100 will absorb considerably more energy than the conventional deadbolt system, often made of some form of steel. As the conventional deadbolt system includes primarily rigid components, repeated blows typically weaken the lock assemblies, the door, and/or the doorframe until it a point of failure is reached. The energy absorbing lock system 100 functions after repeated blows.

In certain embodiments, the deformable bolt 140 of the energy absorbing lock system 100 is similar to the form and function of a conventional steel deadbolt found on residential and/or commercial business doors 200. However, the materials used in the construction may be substantially different. In certain embodiments, the deformable bolt 140 (e.g., the deadbolt) is constructed of a hardened steel spine 160 (e.g., a spring steel spine) of about 0.025 to about 0.070 inch thickness that is secured to a steel end cap 170 that is about 3/16 inch thick. The hardened steel spine 160 is then covered with a neoprene or an isoprene materiel to create a body of the deformable bolt 140. In other embodiments, the hardened steel spine 160 and/or the steel end cap 170 may be omitted.

The bolt receiver 220 (i.e., the female structure) may be composed of all steel and fit into an opening 320 of the jamb 310 where a conventional female receiver from a conventional deadbolt system fits into the door frame 300. However, in certain embodiments, the bolt receiver 220 fully lines the opening 320 thus forming a hollow cavity 226 (e.g. a pocket made of steel). The bolt receiver 220 may include an exterior plate 224 (see FIG. 1) with outside dimensions of 2¼ inch×1 inch, which are industry standards in the United States. The exterior plate 224 may have two holes 236 for screws 238 that may be of standard diameter. The female opening 226 may have an industry standard height of ¾inch and may include a typical semi-half oval form 228 on opposing top and bottom ends.

A difference between the typical face plate and the bolt receiver 220 may be found at a side 222 (see FIG. 10) of the female opening 226 that first receives the deformable bolt 140. It may be wider at this point (e.g., ¾inch) than the standard opening (⅝ inch) at the face plate 224, but only slightly wider than the distal male end 144 of the steel end cap 170 of the deformable bolt 140 at a distal end 242 of the hollow cavity 226 (i.e., the hollow opening). A purpose of the narrowing of the cavity 226 may be to allow the deformable bolt 140 to seat in an innermost depth 242 of the cavity 226. When the door 200 is struck with force, the first point to make contact with the bolt receiver 220 (i.e., the female apparatus) may be the end cap 170 of the deformable bolt 140. As force is placed on the deformable bolt 140, it will begin absorbing energy and bending and/or otherwise deforming. While bending, a first side 152 (see FIG. 9) of the deformable bolt 140 will make contact (e.g., bearing contact) along the offset inner wall 230 of the bolt receiver 220 until it reaches an edge 234 of the faceplate 224. At this point, the deformable bolt 140 will absorb energy while bending the inner hardened steel spine 160, all while cushioning the blow as the material (e.g., the neoprene material) compresses and/or otherwise deforms.

Figure 10:
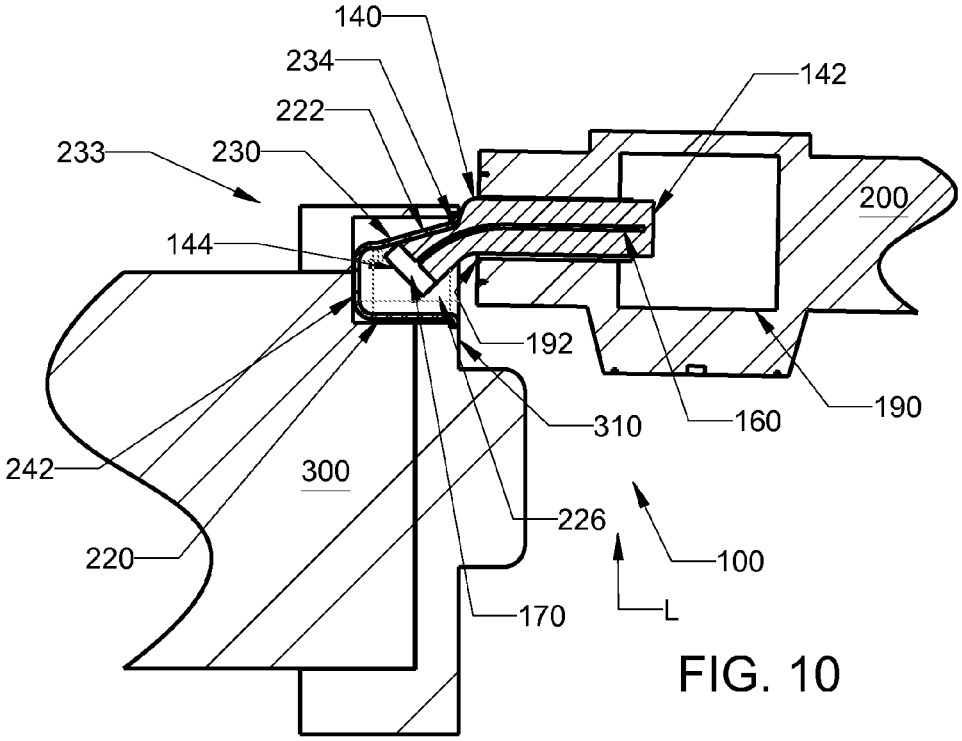
FIG. 10 is the partial cross-sectional plan view of FIG. 9, but with the door lock system shown in a deformed bolt-jamming configuration.
Figure 9:
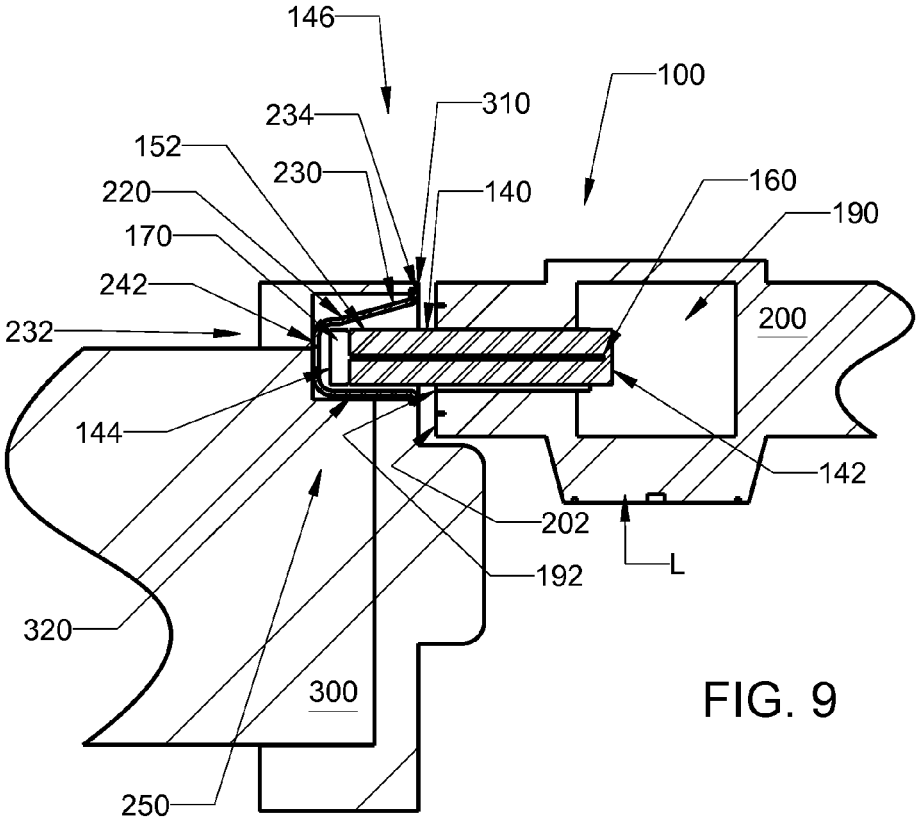
FIG. 9 is a partial cross-sectional plan view of the door lock system of FIG. 1, shown in the normally closed configuration.
Figure 11:
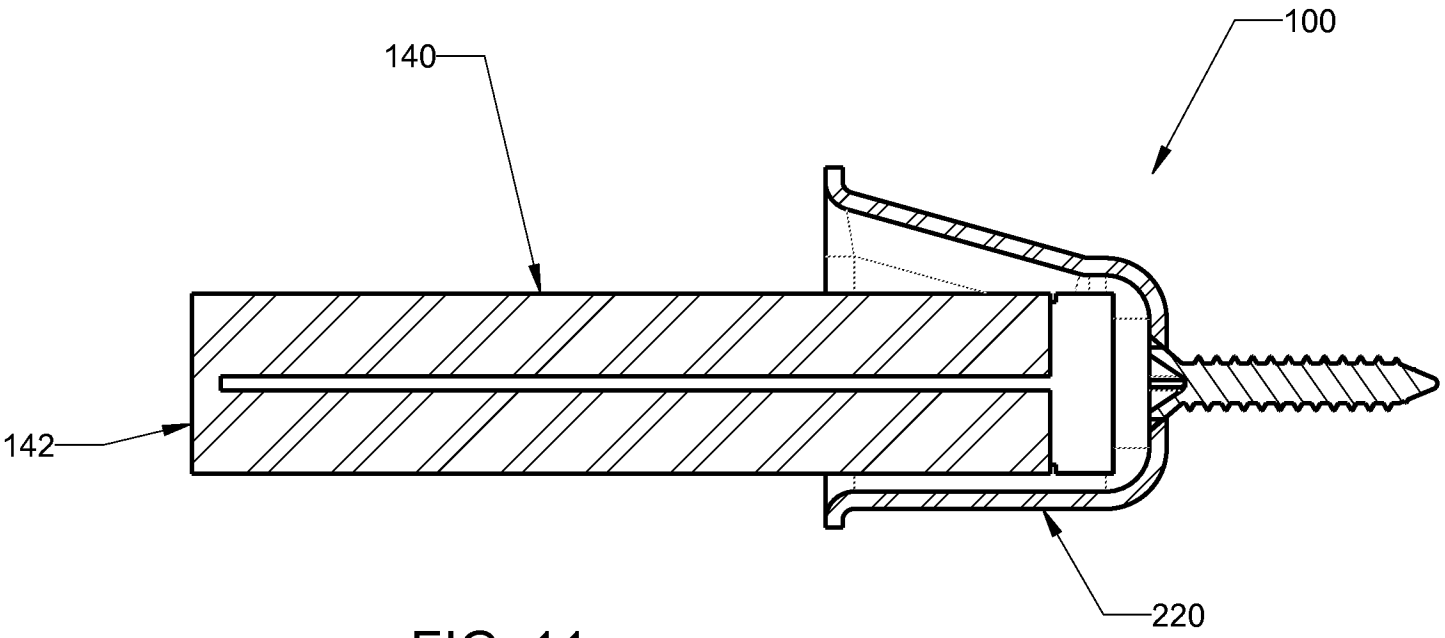
FIG. 11 is a cross-sectional plan view of a portion of the door lock system of FIG. 1, shown in the normally closed configuration.
Figure 12:
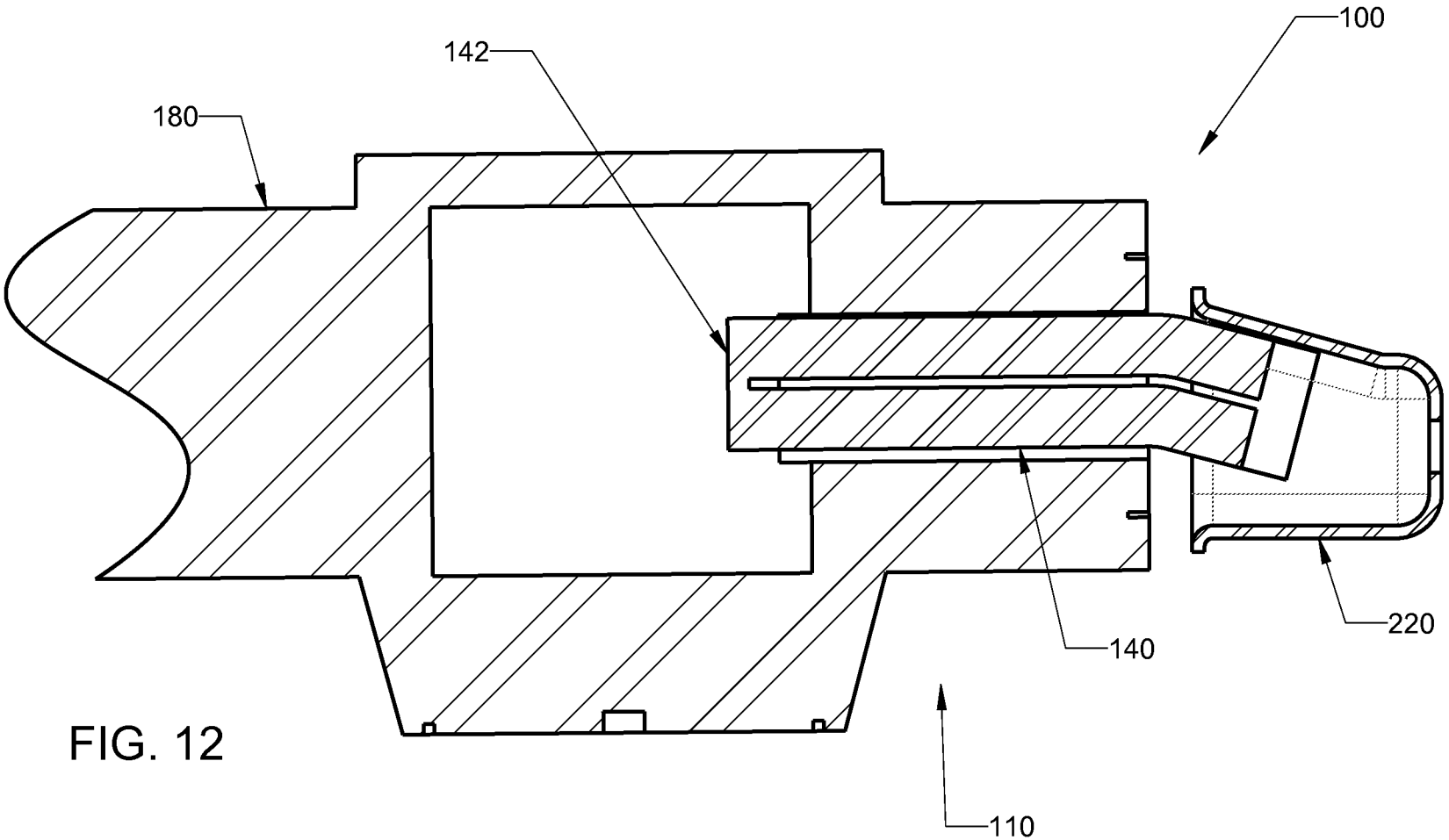
FIG. 12 is a cross-sectional plan view of the door lock system of FIG. 1, shown in the deformed configuration.

In the event that the perpetrator should continue to repeatedly deliver blows to the door 200, the deformable bolt 140 may bend, compresses, and/or otherwise deforms in a manner that causes the door 200 to pinch the deformable bolt 140 into the doorframe 300 making thereby jamming the door 200 (see FIGS. 9 and 10).

Figure 3:
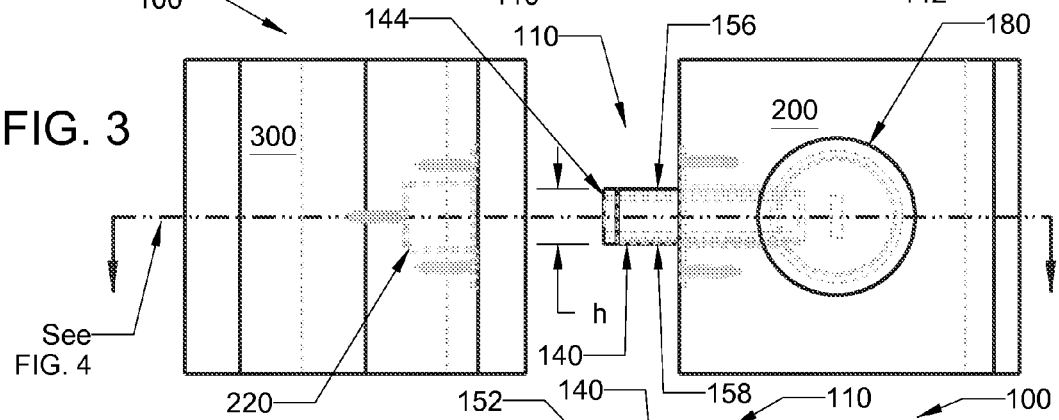
FIG. 3 is a partial exploded elevation view of the door lock system of FIG. 1.
Figure 5:
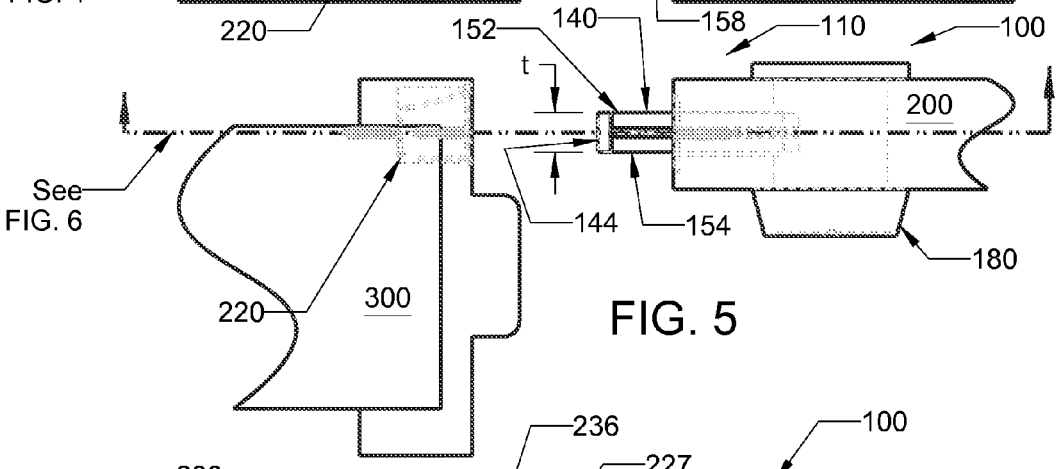
FIG. 5 is a partial exploded plan view of the door lock system of FIG. 1.

Turning now to FIGS. 3, 5, 7, and 9, the energy absorbing bolt 140 will be described in detail. As illustrated at FIG. 5, the energy absorbing bolt 140 generally defines a thickness t that extends between the first side 152 and a second side 154. As illustrated at FIG. 3, the energy absorbing bolt 140 generally defines a height h that extends between a third side 156 and a fourth side 158. As illustrated at FIG. 2, the third side 156 and the fourth side 158 may include a curved shape and/or a tapered shape. In certain embodiments, the curved shape matches similar shapes of conventional bolts found on conventional door lock assemblies. In certain embodiments, the height h is generally 0.75 inch, and the thickness t is generally 0.625 inch.

As mentioned above, the energy absorbing bolt 140 may terminate at a distal end 144. The cap 170 may define the distal end 144. In other embodiments, the distal end 144 of the energy absorbing bolt 140 may not include a cap. The general perimeter of the energy absorbing bolt 140 may continue across a thickness of the cap 170. In particular, the cap 170 may also define the thickness t and the height h. The first side 152, the second side 154, the third side 156, and the fourth side 158 may continue in a smooth and uninterrupted manner across the energy absorbing bolt 140, including the cap 170.

Figure 7:
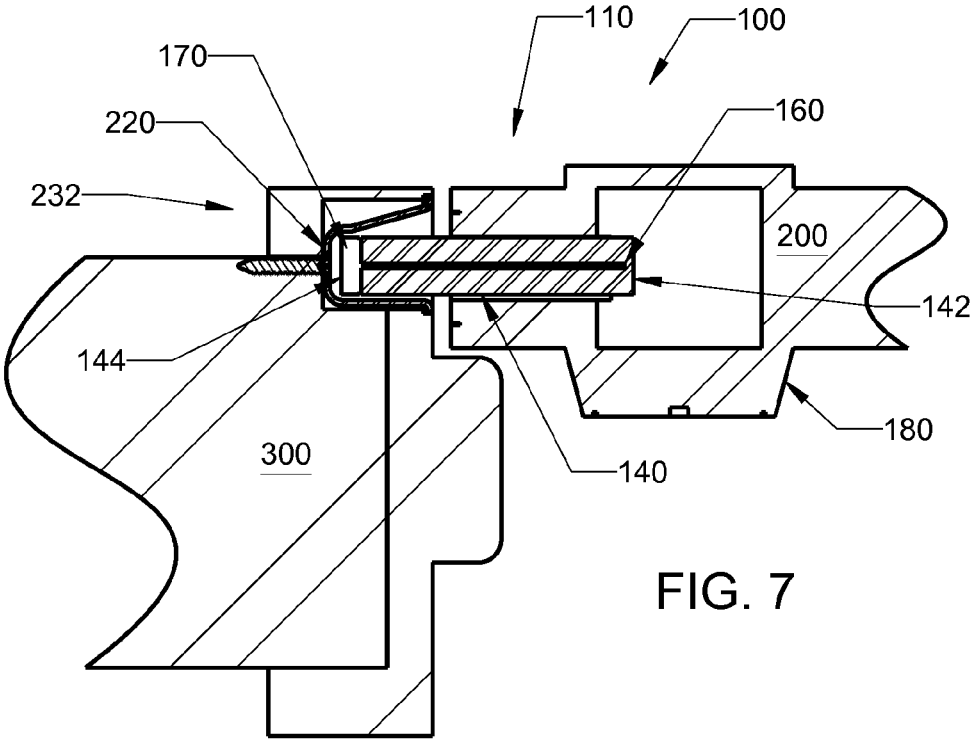
FIG. 7 is a partial cross-sectional plan view of the door lock system of FIG. 1, shown in a normally closed configuration.

The energy absorbing bolt 140 extends between the proximal end 142 and the distal end 144. As depicted at FIGS. 7 and 9, the proximal end 142 of the energy absorbing bolt 140 may be positioned a substantial distance away from the end 202 of the door 200 and may be positioned within the door 200.

The energy absorbing bolt 140 includes a first portion 146, adjacent the proximal end 142, and a second portion 148, adjacent the distal end 144. The proximal end 142 retracts within the bolt guide 190 when the deformable bolt and actuator assembly 110 are in the unlocked position. In particular, the distal end 144 of the energy absorbing bolt 140 may be substantially flush with the end 202 of the door 200. When the deformable bolt and actuator assembly 110 is moved to the locked configuration, the first portion 146 is slid out of the bolt guide 190 and extends beyond the end 202 of the door 200.

Figure 6:
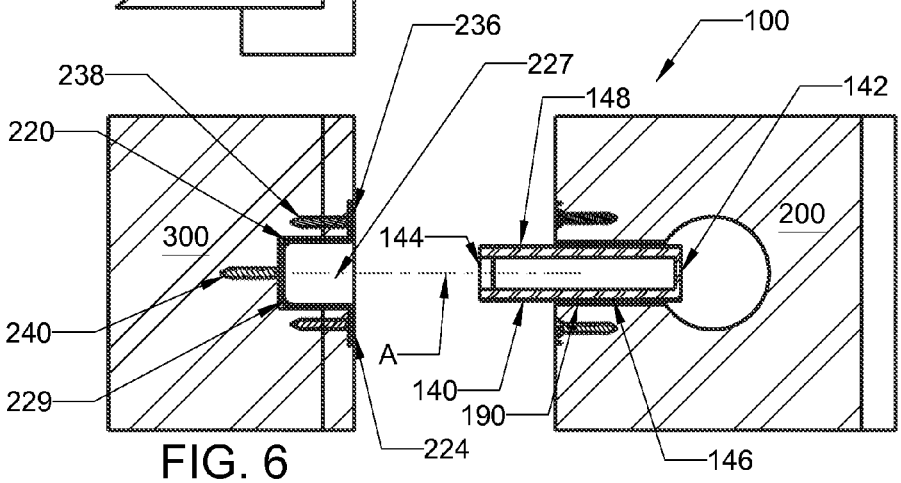
FIG. 6 is a partial exploded cross-sectional elevation view of the door lock system of FIG. 1, as called out at FIG. 5.

Turning now to FIGS. 6, 9, and 10, the bolt receiver 220 will be described in additional detail. In certain embodiments, the bolt receiver 220 is formed of a continuous material and thereby is substantially stronger than a conventional bolt receiver. In certain embodiments, the cavity 226 of the bolt receiver 220 is surrounded on all sides except an opening 227 of the cavity 226. Thus, the cavity 226 is surrounded by a perimeter of material 225 that generally extends around an axis A defined by the energy absorbing bolt 140 (e.g., as the energy absorbing bolt 140 slides). A bottom 229 of the cavity 226 may be integrally attached to (e.g., one monolithic piece with) the perimeter 225. The bolt receiver 220 thereby defines a cup-shape structure with a high degree of strength as it is reinforced in every direction by the perimeter 225 and the bottom 229.

The bolt receiver 220 may further include the exterior plate 224 (i.e., the strike plate). The exterior plate 224 may serve as a flange around the perimeter 225 and further strengthen and reinforce the bolt receiver 220. As depicted at FIG. 6, the bolt receiver 220 may include a set of holes 236 through the exterior plate 224. As depicted at FIG. 6, the bottom 229 of the hollow cavity 226 may include another hole 236. A pair of fasteners 238 (e.g., screws) may attach the exterior plate 224 to the jamb 310 of the door frame 300. A fastener 240 may secure the bottom 229 of the hollow cavity 226 to the door frame 300. The fasteners 238 and/or 240 may extend beyond the jamb 310 of the door frame 300 and structurally attach the bolt receiver 220 to a frame of the building. By including the holes 236 and the fasteners 238, 240 as illustrated, the bolt receiver 220 is mounted with a high degree of structural stability. In particular, the fasteners 238, 240 are positioned in at least two planes that are separated by a distance. In contrast, a conventional strike plate may only fasten to the jamb of the door frame at a single plane.

The bolt receiver 220 may include a portion 250 that engages snugly with the energy absorbing bolt 140. As depicted at FIG. 9, the portion 250 is included adjacent the bottom 229 and/or the distal end 242 of the bolt receiver 220. The distal end 144 of the energy absorbing bolt 140 may engage the portion 250 snugly and thereby give a positive feel to the locking of the door 200 when under normal loading conditions. The positive feel when closing and locking may feel much like the locking of a conventional door lock. The snug fitting between the distal end 144 and the portion 250 does not interfere with and may enhance the overall dynamic deformation characteristic of the energy absorbing lock system 100 when the intrusion load L is placed on the door 200. In certain embodiments, the cap 170 engages with the portion 250 and thereby provides the energy absorbing lock system 100 with a metal-on-metal interface when the deformable bolt and actuator assembly 110 is positioned to and/or from the locking position.

Turning now to FIGS. 1 and 2, exploded perspective views illustrate the energy absorbing lock system 100, as installed on the door 200 and the door frame 300. As depicted, the deformable bolt and actuator assembly 110 are installed in the door 200, and the bolt receiver 220 is installed in the door frame 300. In other embodiments, the deformable lock and actuator assembly 110 may be installed in a door frame, and the bolt receiver 220 may be installed in a door. As depicted, the door 200 is a conventional door found, for example, on residential dwellings, business buildings, school buildings, etc. The door 200 may be made of metal, wood, plastic, composites, etc. In certain embodiments, the door 200 includes a framework inside the door 200. In such embodiments, the deformable bolt and actuator assembly 110 and/or the energy absorbing bolt 140 may be structurally connected to the framework of the door 200. In other embodiments, the deformable bolt and actuator assembly 110 and/or the energy absorbing bolt 140 may not be substantially attached to a framework of the door 200.

In certain embodiments, the door 200 is hung from the door frame 300 and pivots about hinge axes that are defined by hinges mounted between the door 200 and the door frame 300. In certain embodiments, as illustrated at FIGS. 9 and 10, the door 200 is constrained to normally open in only one rotational direction. In other embodiments, the door 200 may swing inwardly and outwardly about a door hinge axis and/or about door hinge axes (e.g., about a French door hinge system).

Figure 8:
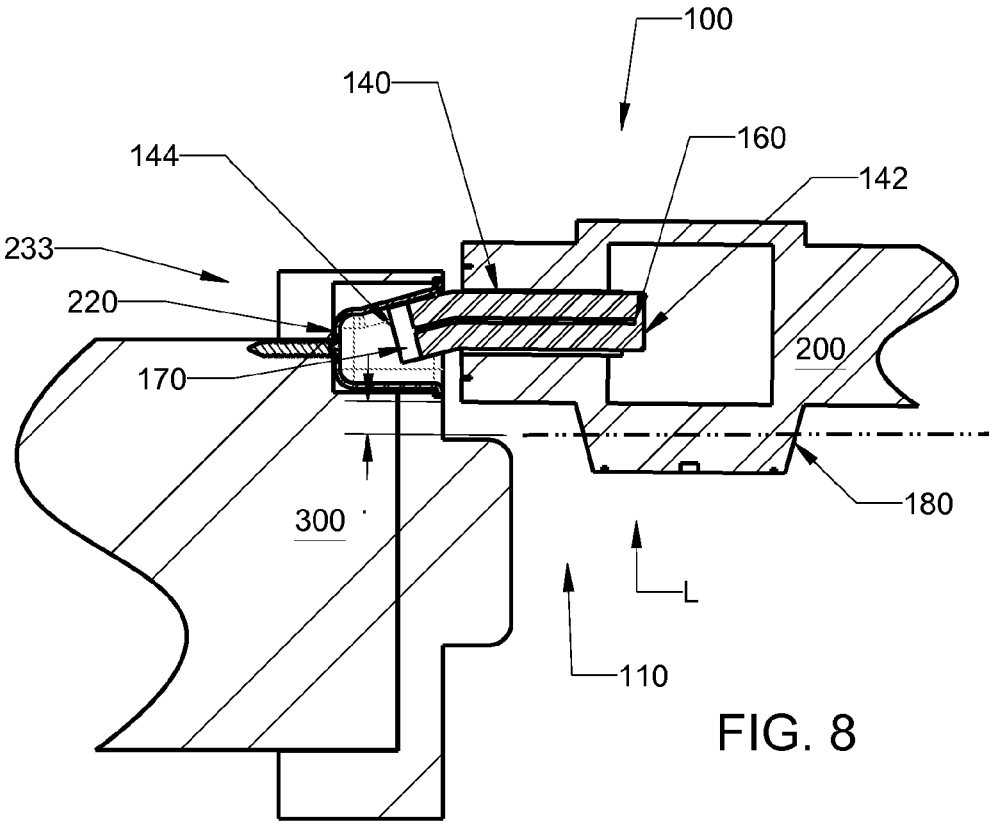
FIG. 8 is the partial cross-sectional plan view of FIG. 7, but with the door lock system shown in a deformed configuration.

As illustrated at FIGS. 9 and 10, the energy absorbing bolt 140 fits into the bolt receiver 220 and thereby locks the door 200 in a closed position. FIG. 9 illustrates the door 200 in a normal locked position. FIG. 10 illustrates the door 200 in a locked position, but with an intrusion load L applied against the door 200 thereby displacing (e.g., linearly displacing, rotationally displacing, or linearly and rotationally displacing the door 200). As illustrated at FIG. 9, when the door 200 is in the normally locked position, the energy absorbing bolt 140 occupies a first portion 232 of the bolt receiver 220. As illustrated at FIG. 10, when the intrusion load L is applied to the door 200, a portion of the energy absorbing bolt 140 occupies a second portion 233 of the cavity 226 of the bolt receiver 220. The deformation guiding portion 230 may control the deformation of the energy absorbing bolt 140 and may thereby influence the energy absorption of the energy absorbing bolt 140. FIG. 8 also shows the energy absorbing bolt 140 occupying the second portion 233 of the cavity 226 of the bolt receiver 220 when the intrusion load L is placed against the door 200. FIG. 7 also illustrates the door 200 in the normal locked position with the energy absorbing bolt 140 positioned in the first portion 232 of the cavity 226 of the bolt receiver 220.

FIG. 8 illustrates the energy absorbing bolt 140 absorbing energy by a bending mode. In certain embodiments, this bending mode may be a first mode that the energy absorbing bolt 140 enters while protecting the door 200 and the door frame 300 from the intrusion load L. Upon the intrusion load L increasing in magnitude, the energy absorbing bolt 140 may enter a compression mode (e.g., a pinching mode). By entering the compression mode or a second mode, the energy absorbing bolt 140 may employ additional energy absorbing means to prevent the door 200 from opening under the intrusion load L. These additional energy absorbing means may be used in isolation or together in various combinations with any other energy absorbing means.

These energy absorbing means may include the cap 170 contacting the cavity 226 of the bolt receiver 220 thereby placing the metal insert 160 in tension. These energy absorbing means may include a compressing of material of the energy absorbing bolt 140. In particular, the edge 234 of the cavity 226 of the bolt receiver 220 may initiate substantial compression into the energy absorbing bolt 140. As illustrated, the edge 234 includes a curved profile (e.g., a radius) that may influence the compression means of absorbing energy by the energy absorbing bolt 140. In particular, the radius of the edge 234 should be large enough to avoid cutting the material of the energy absorbing bolt 140. However, the radius of the edge 234 may be sized sufficiently small to penetrate by compression the first side 152 of the energy-absorbing bolt 140. A bolt guide 190 may guide normal sliding of the energy absorbing bolt 140 when the actuator 180 moves the energy absorbing bolt 140 between the locked position and an unlocked position. The bolt guide 190 may include an edge 192. The edge 192 may include a curved radius similar to the edge 234 of the cavity 226 of the bolt receiver 220. The edges 192 and 234 may together bite into the energy absorbing bolt 140 and thereby resist the opening of the door 200 under the intrusion load L.

The energy absorbing bolt 140 may further include high friction as an additional energy absorbing means to resist the opening of the door 200 under the intrusion load L. The high friction may generally operate between the jamb 310 of the door frame 300 and an end 202 of the door 200 adjacent the deformable bolt and actuator assembly 110. In certain embodiments, the intrusion load L may be sufficient to bind-up the door 200, the energy absorbing bolt 140, and the jamb 310 of the door frame 300 and may thereby cause the door 200 to stick with the energy absorbing bolt 140 jammed between the door 200 and the door frame 300.

Figure 13:
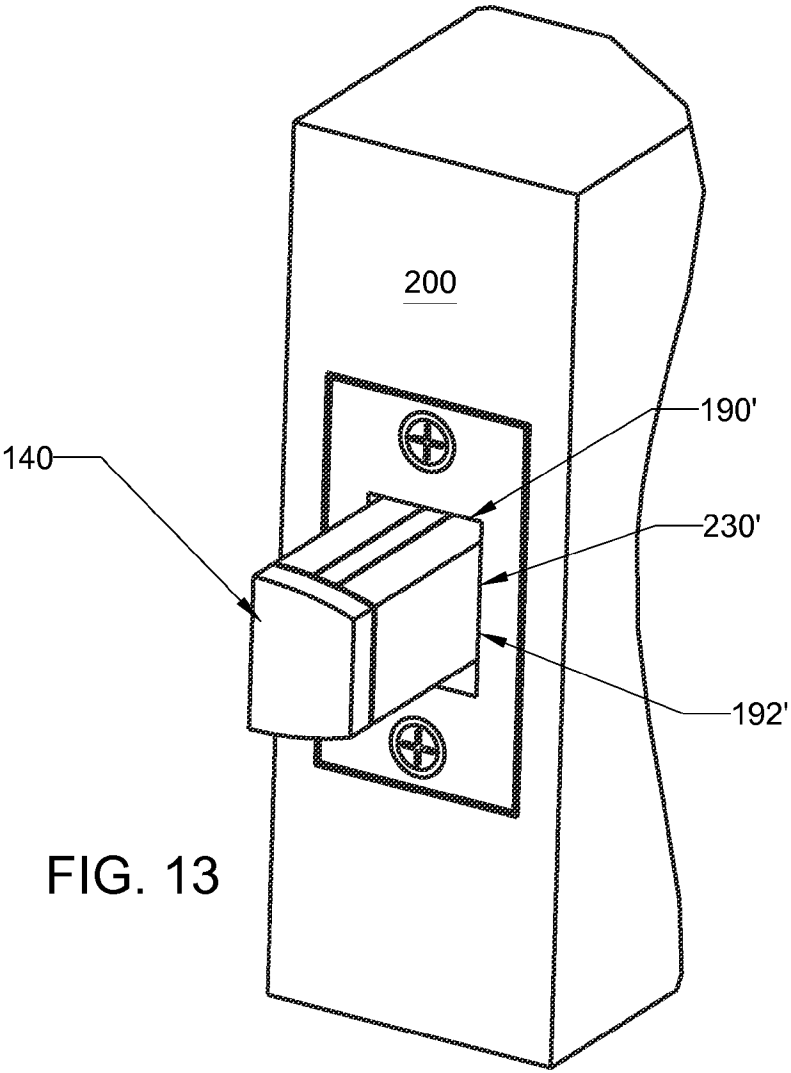
FIG. 13 is a partial perspective view of another door lock system according to the principles of the present disclosure.
Figure 14:
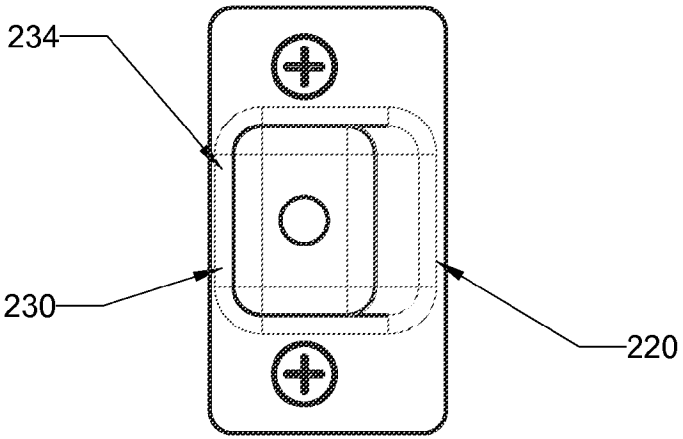
FIG. 14 is an elevation view of a strike plate suitable for use with the door lock system of FIG. 13.

Turning now to FIGS. 13 and 14, another energy absorbing lock system 200, according to the principals of the present disclosure, is illustrated. The energy absorbing lock system 200 may include some or all of the features of the energy absorbing lock system 100. The energy absorbing lock system 200 further includes a deformation guiding portion 230' at or adjacent an edge 192' of a bolt guide 190'. The deformation guiding portion 230' operates in much the same manner as the deformation guiding portion 230, described above. However, the deformation guiding portion 230' is a part of the bolt guide 190'. The deformation guiding portion 230' may be used in conjunction with the deformation guiding portion 230. By combining two deformation guiding portions 230, 230', additional energy may be absorbed by the energy absorbing bolt 140. As depicted, the deformation guiding portion 230' resides on the door 200 and the deformation guiding portion 230 resides on the door frame 300.

As depicted, the energy absorbing bolt 140 is made of material that may be extruded along the bolt axis A (see FIG. 6). For example, the hardened steel and/or spring steel spine 160 (i.e., the spring spine) includes an extruded shape along the bolt axis A. In other embodiments, the material of the energy absorbing bolt 140 may be extruded in other directions and/or varying directions. For example, the energy absorbing bolt 140 may include a coil spring (e.g., a steel coil spring) that may follow a helical path. The coil spring may include a net shape of the energy absorbing bolt 140 and/or the coil spring may include a coating covering the coil spring. The coil spring may be embedded in other energy absorbing material or other material of the energy absorbing bolt 140. In other embodiments, a non-coil spring of the energy absorbing bolt 140 may also include a net shape of the energy absorbing bolt 140 (e.g., a pair of leaf springs) and/or the non-coil spring may include a coating of the energy absorbing bolt 140 covering the non-coil spring. The non-coil spring may be embedded in other energy absorbing material or other material of the energy absorbing bolt 140.

The energy absorbing bolt 140 may further include the following materials, either alone or in combination with other material or materials.

Viton Extreme from DuPont
Tetrafluoroethylene Propylene, FEPM
Silicone Rubber, VMQ/PVMQ
Polyurethane Elastomer, AU or EU
Polysulphide Rubber, TR
Perfluoroelastomer, FFKM—known as the DuPont product Kalrez
Hydrogenated Nitrile Rubber, HNBR
Nitrile Butadiene Rubber, NBR
Fluorosilicone, FVMQ
Fluorelastomere, FKM/FPM, also known as Viton Elastomer by DuPont
Ethylene Propylene Copolymer EPM or EPDM
Epichlorhydrin (CO)
Chlorosulphonated Polyethylene (CSM)
Chloronated Polyethylene (CPE)
Ethylene Acrylic, AEM
Alkyl Acrylic copolymer, ACM
Polychloroprene, CR
Chlorobutyl Rubber (CIIR)
Isobutylene-isopropene copolymere (IIR)
Polybutadiene (BR)
Stryrene Butadiene (SBR)
Synthetic cis-polyisoprene (IR)
Natural Cis-Polyisoprene (NR)

This application is being filed concurrently with a U.S. non-provisional patent application known by Ser. No. 14/211,738 and entitled ENERGY ABSORBING LATCH SYSTEMS AND METHODS which is incorporated herein by reference in its entirety. The subject matter of the ENERGY ABSORBING LATCH SYSTEMS AND METHODS and the subject matter of the present patent application may be used on the same door 200 and/or door frame 300.

Various modifications and alterations of this disclosure will become apparent to those skilled in the art without departing from the scope and spirit of this disclosure, and it should be understood that the scope of this disclosure is not to be unduly limited to the illustrative embodiments set forth herein.

What is claimed is:

1. A door lock assembly adapted to secure a door in a closed configuration within a doorframe, the door lock assembly comprising:

a bolt guide;

a bolt extending between a proximal end and a distal end, the bolt including a first portion adjacent the proximal end and a second portion adjacent the distal end, and the bolt including a spring metal core surrounded by an energy absorbing polymer;

a bolt actuator adapted to move the bolt along the bolt guide between a locked position and an unlocked position, the second portion of the bolt extending beyond the bolt guide when the bolt is moved to the locked position; and a bolt receiver adapted to receive the second portion of the bolt when the bolt is moved to the locked position;

wherein the bolt is adapted to deform within the bolt receiver and thereby absorb energy delivered to the door lock assembly by an intrusion load; and wherein the energy delivered to the door lock assembly by the intrusion load is predominantly absorbed by deformation of the bolt.

2. The door lock assembly of claim 1, wherein the bolt is a deadbolt.

3. The door lock assembly of claim 1, wherein the bolt actuator is actuated by a key.

4. The door lock assembly of claim 1, wherein the bolt receiver includes an integral strike plate.

5. The door lock assembly of claim 4, wherein the bolt receiver is a cup shaped bolt receiver and is adjacent the second portion of the bolt along at least three sides of the second portion of the bolt when the bolt is moved to the locked position.

6. The door lock assembly of claim 5, wherein the cup shaped bolt receiver is adjacent the second portion of the bolt along all exterior sides of the second portion of the bolt when the bolt is moved to the locked position.

7. The door lock assembly of claim 1, wherein the bolt receiver includes a first portion adapted to receive the second portion of the bolt when the bolt is moved to the locked position and no intrusion load is placed on the door and wherein the bolt receiver includes a second portion adapted to receive at least some of the second portion of the bolt when the bolt is positioned at the locked position and the intrusion load is placed on the door thereby deforming the bolt.

8. The door lock assembly of claim 7, wherein the second portion of the bolt receiver includes a deformation guide that guides the deformation of the bolt when the intrusion load is placed on the door.

9. The door lock assembly of claim 8, wherein the deformation guide of the second portion of the bolt receiver includes a taper.

10. The door lock assembly of claim 1, wherein the deformation of the bolt is elastic deformation.

11. The door lock assembly of claim 1, wherein the bolt guide is mounted to the door and the bolt receiver is mounted to the doorframe.

12. The door lock assembly of claim 1, wherein the bolt further includes a metal end cap at the distal end that is connected to the spring metal core.

13. The door lock assembly of claim 1, wherein the bolt guide includes a deformation guide that guides the deformation of the bolt when the intrusion load is placed on the door.

14. A door lock assembly adapted to secure a door in a closed configuration within a doorframe, the door lock assembly comprising:

a bolt guide;

a bolt extending between a proximal end and a distal end, the bolt including a first portion adjacent the proximal end and a second portion adjacent the distal end and the bolt including a thickness;

a bolt actuator adapted to move the bolt along the bolt guide between a locked position and an unlocked position, the second portion of the bolt extending beyond the bolt guide when the bolt is moved to the locked position; and a bolt receiver adapted to receive the second portion of the bolt when the bolt is moved to the locked position;

wherein the bolt is adapted to deform within the bolt receiver and thereby absorb energy delivered to the door lock assembly by an intrusion load when the intrusion load is applied to the door in the closed configuration and the bolt is at the locked position; and wherein the bolt is configured such that the bolt can deform at least 4% of the thickness of the bolt before failure of the door lock assembly occurs from the intrusion load.

15. The door lock assembly of claim 14, wherein the bolt is configured such that the bolt can deform at least 25% of the thickness of the bolt before the failure of the door lock assembly occurs from the intrusion load.

16. The door lock assembly of claim 14, wherein the bolt is configured such that the bolt can deform at least 120% of the thickness of the bolt before the failure of the door lock assembly occurs from the intrusion load.

17. The door lock assembly of claim 1, wherein the bolt guide is adapted to guide the bolt along a substantially linear path when the bolt is moved by the bolt actuator.

18. The door lock assembly of claim 14, wherein the bolt guide is adapted to guide the bolt along a substantially linear path when the bolt is moved by the bolt actuator.

* * * * *